US008109305B1

(12) United States Patent
Kosmidis

(10) Patent No.: US 8,109,305 B1
(45) Date of Patent: Feb. 7, 2012

(54) LOG SPLITTER ATTACHMENT

(76) Inventor: Angelo Kosmidis, Tuxedo Park, NY (US)

( * ) Notice: Subject to any disclaimer, the term of this patent is extended or adjusted under 35 U.S.C. 154(b) by 139 days.

(21) Appl. No.: 12/731,266

(22) Filed: Mar. 25, 2010

(51) Int. Cl.
*B27L 7/06* (2006.01)

(52) U.S. Cl. ..... 144/195.5; 144/193.2

(58) Field of Classification Search ..... 144/193.1, 144/193.2, 195.8, 195.1, 195.7, 4.6
See application file for complete search history.

(56) References Cited

U.S. PATENT DOCUMENTS

D255,686 S 7/1980 Duppong et al.
4,353,401 A * 10/1982 Schilling ..... 144/195.1
4,421,149 A 12/1983 Barnes et al.
5,320,149 A 6/1994 Peterson et al.
5,337,810 A * 8/1994 McCormack ..... 144/195.1
6,763,864 B2 7/2004 Setlack et al.
7,066,223 B2 6/2006 Stone
2003/0155037 A1 8/2003 Alexander

* cited by examiner

*Primary Examiner* — Shelley Self

(57) ABSTRACT

A log splitter attachment for attaching to a machine such as an excavator or backhoe boom to facilitate splitting of large diameter logs into multiple triangular wedges includes a central portion and an attachment portion coupled to the central portion such that the central portion is designed for attachment to the boom arm of a machine such as a back hoe or excavator. A plurality of planar sections is coupled to the central portion. The planar sections are arranged to extend radially outward from the central portion. A plurality of distal wedge members is provided. Each distal splitting wedge member is coupled to a respective one of the plurality of planar sections. A central wedge splitting member has a plurality of radial wedge portions. The central wedge splitting member is coupled to a base of the central portion.

16 Claims, 5 Drawing Sheets

LOG SPLITTER ATTACHMENT

BACKGROUND OF THE DISCLOSURE

Field of the Disclosure

The disclosure relates to log splitters and more particularly pertains to a new log splitter for attaching to a machine such as an excavator or backhoe boom to facilitate splitting of large diameter logs into multiple triangular wedges.

SUMMARY OF THE DISCLOSURE

An embodiment of the disclosure meets the needs presented above by generally comprising a central portion and an attachment portion coupled to the central portion such that the central portion is designed for attachment to the boom arm of a machine such as a back hoe or excavator. A plurality of planar sections is coupled to the central portion. The planar sections are arranged to extend radially outward from the central portion. A plurality of distal wedge members is provided. Each distal splitting wedge member is coupled to a respective one of the plurality of planar sections. A central wedge splitting member has a plurality of radial wedge portions. The central wedge splitting member is coupled to a base of the central portion.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
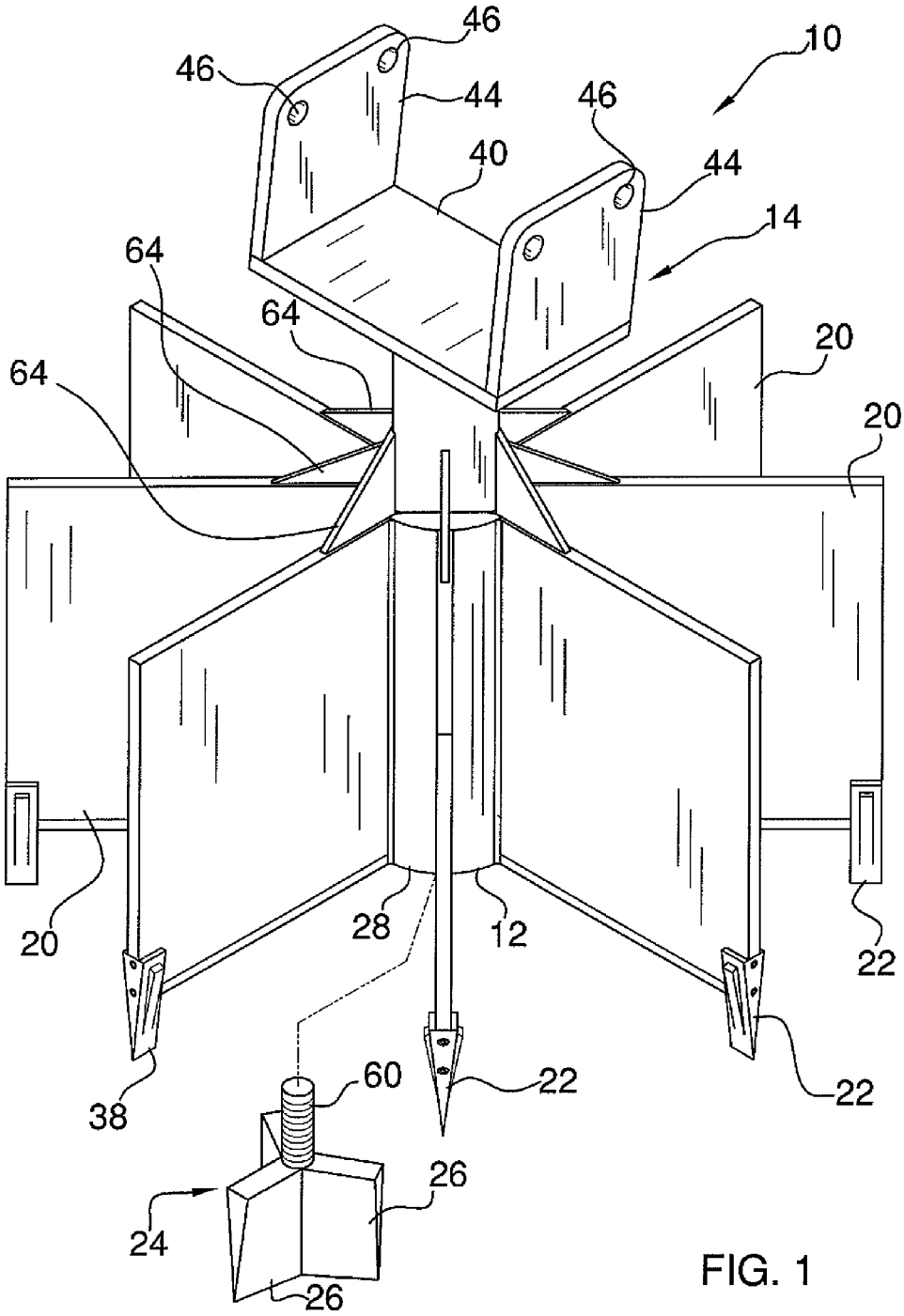
FIG. 1 is a partially exploded top side perspective view of a log splitter attachment according to an embodiment of the disclosure.
Figure 2:
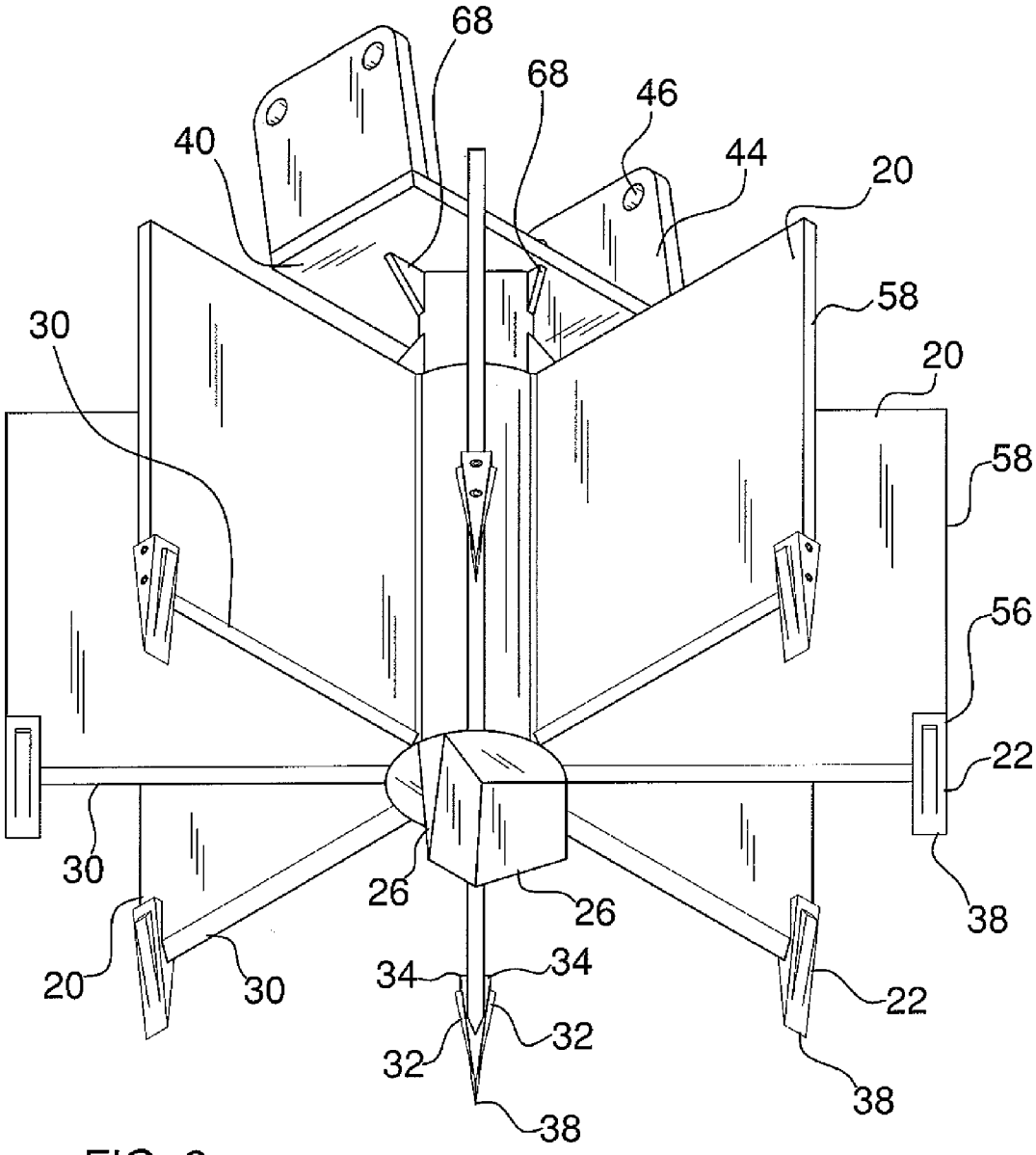
FIG. 2 is a bottom side perspective view of an embodiment of the disclosure.
Figure 3:
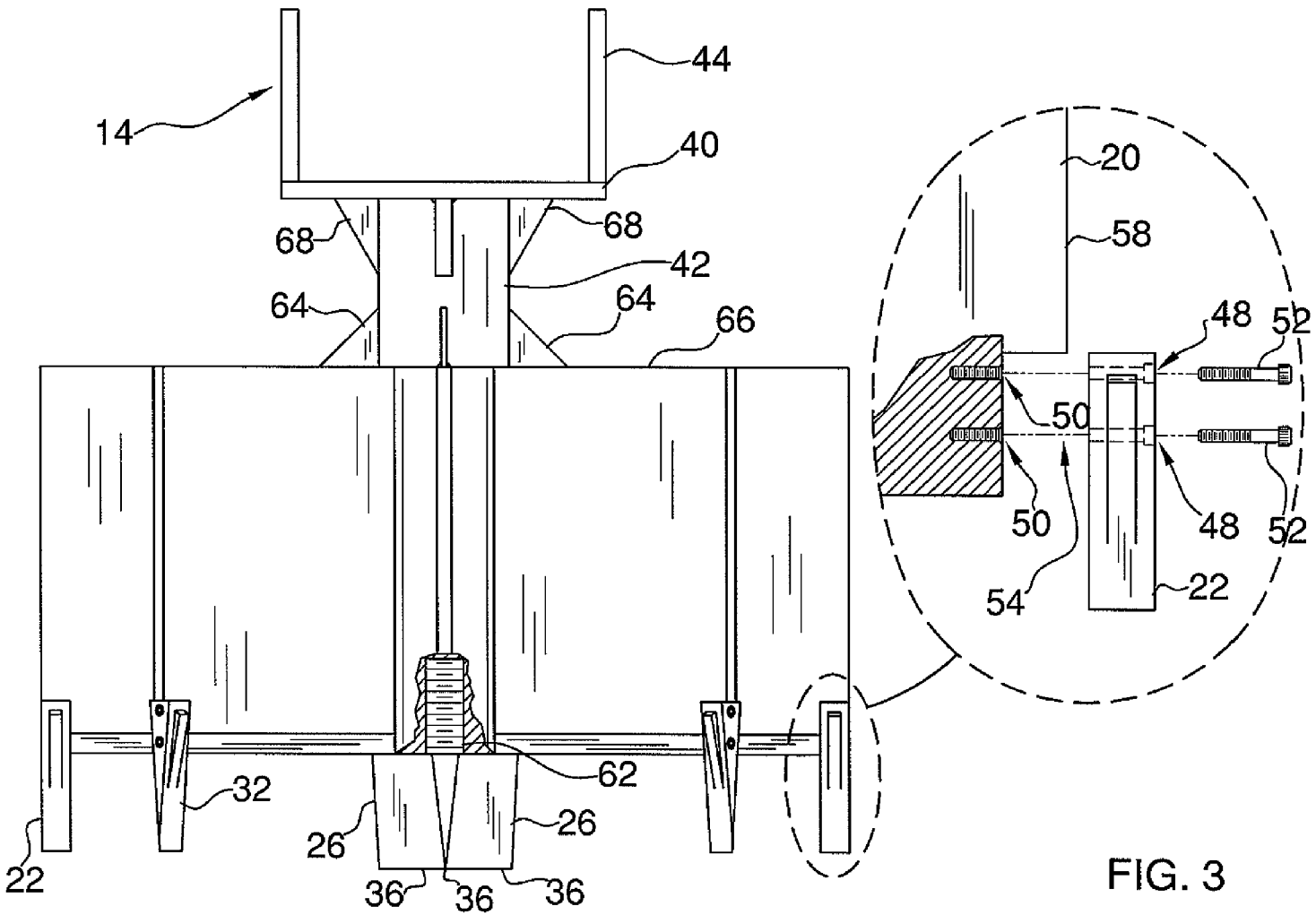
FIG. 3 is a partial cut-away side view of an embodiment of the disclosure.
Figure 4:
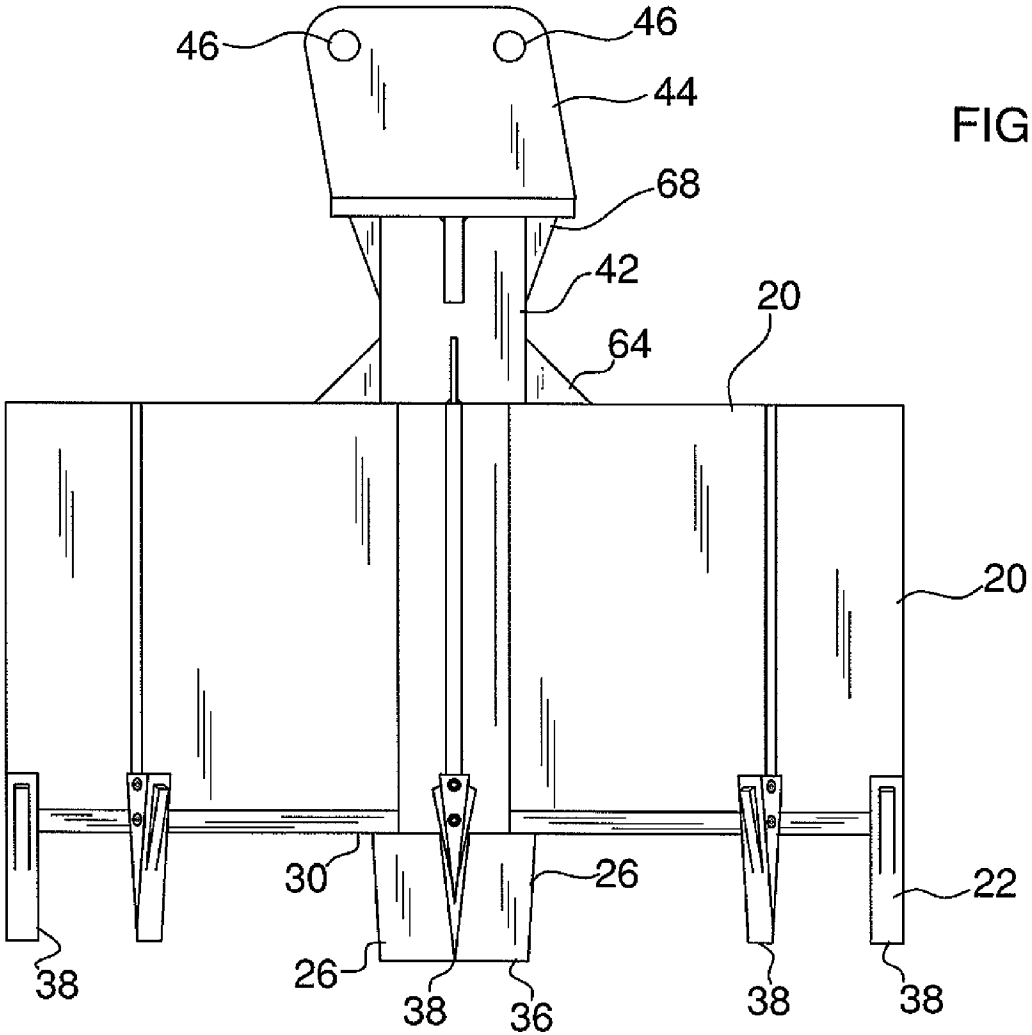
FIG. 4 is a side view of an embodiment of the disclosure.
Figure 5:
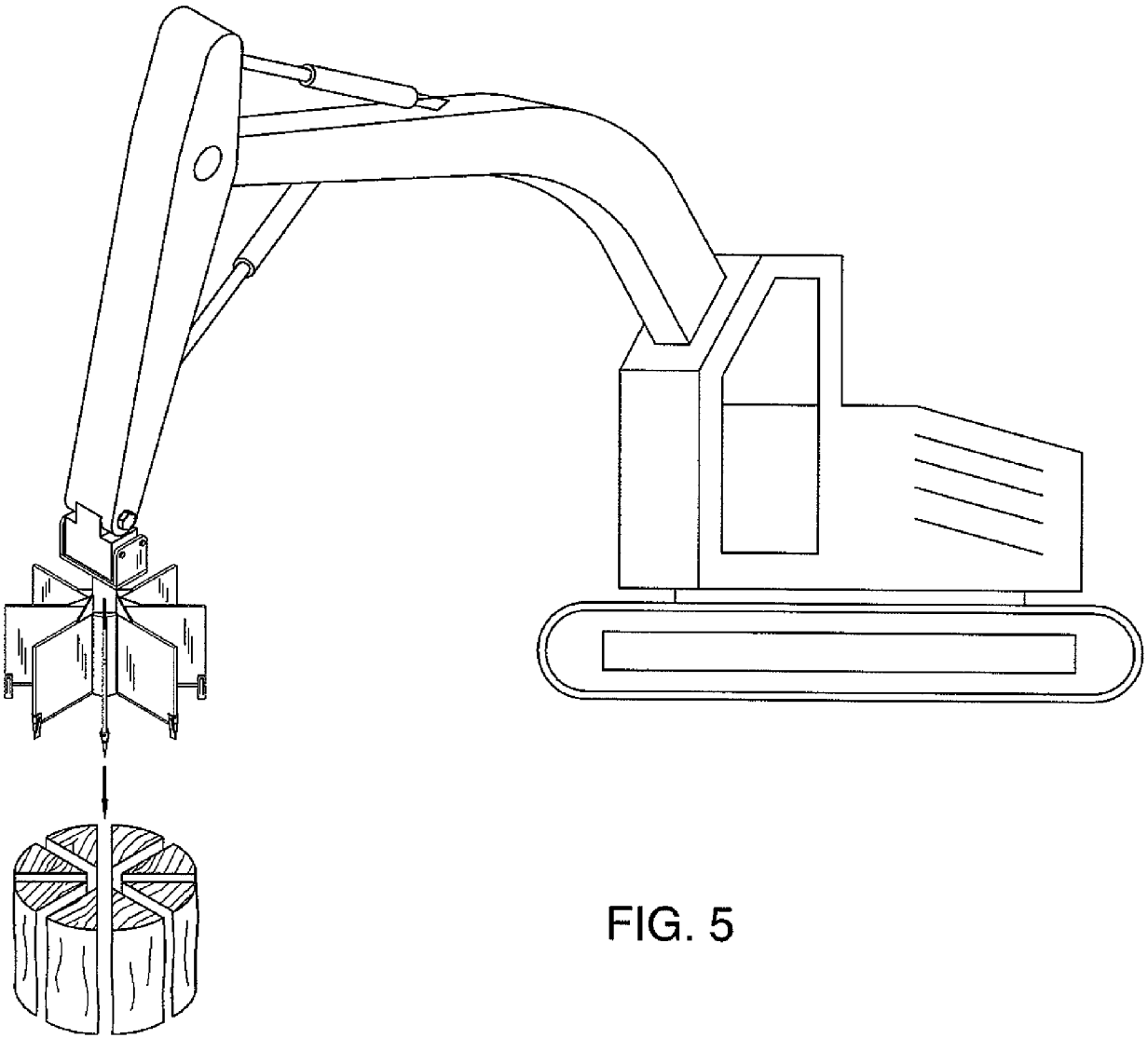
FIG. 5 is a perspective view of an embodiment of the disclosure in use.

With reference now to the drawings, and in particular to FIGS. 1 through 5 thereof, a new log splitter embodying the principles and concepts of an embodiment of the disclosure and generally designated by the reference numeral 10 will be described.

As best illustrated in FIGS. 1 through 5, the log splitter attachment 10 generally comprises a central portion 12 and an attachment portion 14 coupled to the central portion 12 such that the central portion 12 is designed for attachment to the boom arm 16 of a machine 18 such as a back hoe or excavator. A plurality of planar sections 20 is coupled to the central portion 12. The planar sections 20 are arranged to extend radially outward from the central portion 12. A plurality of distal wedge members 22 is provided. Each distal splitting wedge member 22 is coupled to a respective one of the plurality of planar sections 20. A central wedge splitting member 24 has a plurality of radial wedge portions 26. The central wedge splitting member 24 is coupled to a base 28 of the central portion 12.

A bottom edge 30 of each planar section 20 is tapered. Each bottom edge 30 of the planar sections 20 is coplanar to each other bottom edge 30 of the planar sections 20.

Each distal wedge member 22 includes a pair of ramp portions 32. Each ramp portion 32 is positioned on a respective outer face 34 of the distal wedge member 22.

The radial wedge portions 26 each have a respective base edge 36. Each base edge 36 is coplanar to each other base edge 36 of the radial wedge portions 26. Each bottom edge 30 of the planar sections 20 is coplanar to the base 28 of the central portion 12.

The distal wedge members 22 also each have a respective lower edge 38. Each lower edge 38 is coplanar to each other lower edge 38 of the distal wedge members 22. The lower edges 38 of the distal wedge members 22 are also coplanar with the base edges 36 of the radial wedge portions 26.

The attachment portion 14 includes a plate member 40, an extension portion 42 coupled to the plate member 40, and a pair of spaced arm members 44 extending from the plate member 40. The spaced arm members 44 have aligned apertures 46 such that the arm members 44 are designed for coupling to the boom arm 16.

Each of the distal wedge members 22 includes a pair of spaced distal wedge apertures 48. The planar sections 20 each have a pair of spaced threaded portions 50. A plurality of threaded coupling members 52 is provided with each being insertable through a respective one of the distal wedge apertures 50 for removably coupling the distal wedge members 22 to the planar sections 20. Each of the planar sections 20 includes a cutout portion 54 adjacent to the bottom edge 30 of the planar section 20. Each pair of threaded portions 50 is positioned to extend into the respective planar section 20 from the cutout portion 54 such that a distal edge 56 of the distal wedge member 22 is aligned with a distal edge 58 of the planar section 20 when the distal wedge member 22 is coupled to the planar section 20.

The central wedge splitting member 24 has a threaded connection portion 60 and the central portion 12 has a complimentary threaded opening 62 such that the central wedge splitting member 24 is removably couplable to the central portion 12.

A plurality of triangular planar section bracing members 64 is provided. Each planar section bracing member 64 is coupled to extend between the attachment portion 14 and a top edge 66 of a respective one of the planar sections 20. A plurality of plate member bracing members 68 is provided. Each plate member bracing member 68 coupled to extend between the plate member 40 and the extension portion 42.

In use, the attachment portion 14 is attached to the boom arm 16 of a machine 18 such as a back hoe or an excavator. A log is positioned such that the boom arm 16 can be maneuvered to hold the log splitting attachment 10 over the log. The boom arm 16 is lowered so the distal wedge members 22 and central wedge splitting member 24 contact and are driven into and through the log to split the log into triangular sections. The distal wedge members 22 and central wedge splitting member 24 are replaceable as needed. The device may be provided in a variety of sizes to best accommodate splitting of various sizes of logs.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. A log splitter attachment for attaching to a machine having a boom arm, the log splitter attachment comprising:

a central portion;

an attachment portion coupled to said central portion such that said central portion is adapted for attachment to the boom arm;

a plurality of planar sections coupled to said central portion, said planar sections being arranged to extend radially outward from said central portion;

a plurality of distal wedge members, each distal wedge member being coupled to a respective one of said plurality of planar sections; and a central wedge splitting member having a plurality of radial wedge portions, said central wedge splitting member being coupled to a base of said central portion.

2. The log splitter attachment of claim 1, wherein a bottom edge of each said planar section is tapered.

3. The log splitter attachment of claim 1, wherein each distal wedge member includes a ramp portion positioned on an outer face of said distal wedge member.

4. The log splitter attachment of claim 1, wherein each distal wedge member includes a pair of ramp portions, each ramp portion being positioned on a respective one of a pair of opposing outer faces of said distal wedge member.

5. The log splitter attachment of claim 1, wherein each radial wedge portion has a respective base edge, wherein each said base edge is coplanar to each other said base edge of said radial wedge portions.

6. The log splitter attachment of claim 2, wherein each bottom edge of said planar sections is coplanar to each other bottom edge of said planar sections.

7. The log splitter attachment of claim 2, further comprising:

each radial wedge portion having a respective base edge, wherein each said base edge is coplanar to each other base edge; and wherein each bottom edge of said planar sections is coplanar to each other bottom edge of said planar sections and coplanar to said base of said central portion.

8. The log splitter attachment of claim 1, wherein each distal wedge member has a respective lower edge, wherein each lower edge is coplanar to each other lower edge of said distal wedge members.

9. The log splitter attachment of claim 5, further comprising:

each distal wedge member having a respective lower edge, wherein each lower edge is coplanar to each other lower edge of said distal wedge members; and wherein said lower edges of said distal wedge members are coplanar with said base edges of said radial wedge portions.

10. The log splitter attachment of claim 1, wherein said attachment portion includes a plate member, an extension portion coupled to said plate member, and a pair of spaced arm members extending from said plate member, said spaced arm members having aligned apertures such that said arm members are adapted for coupling to the boom arm.

11. The log splitter attachment of claim 1, further comprising:

each of said distal wedge members including a pair of spaced distal wedge apertures;

each of said planar sections having a pair of spaced threaded portions; and a plurality of threaded coupling members each being insertable through a respective one of said distal wedge apertures for removably coupling said distal wedge members to said planar sections.

12. The log splitter attachment of claim 11, wherein each of said planar sections includes a cutout portion adjacent to said bottom edge of said planar section, each said pair of threaded portions being positioned to extend into said respective planar section from said cutout portion such that a distal edge of said distal wedge member is aligned with a distal edge of said planar section when said distal wedge member is coupled to said planar section.

13. The log splitter attachment of claim 1, wherein said central wedge splitting member has a threaded connection portion and said central portion has a complimentary threaded opening such that said central wedge splitting member is removably couplable to said central portion.

14. The log splitter attachment of claim 1, further including a plurality of triangular planar section bracing members, each planar section bracing member being coupled to extend between said attachment portion and a top edge of a respective one of said planar sections.

15. The log splitting attachment of claim 10, further including a plurality of plate member bracing members, each plate member bracing member being coupled to extend between said plate member and said extension portion.

16. A log splitter attachment for attaching to a machine having a boom arm, the log splitter attachment comprising:

a central portion;

an attachment portion coupled to said central portion such that said central portion is adapted for attachment to the boom arm;

a plurality of planar sections coupled to said central portion, said planar sections being arranged to extend radially outward from said central portion;

a plurality of distal wedge members, each distal wedge member being coupled to a respective one of said plurality of planar sections;

a central wedge splitting member having a plurality of radial wedge portions, said central wedge splitting member being coupled to a base of said central portion;

wherein a bottom edge of each said planar section is tapered, each bottom edge of said planar sections being coplanar to each other bottom edge of said planar sections;

wherein each distal wedge member includes a pair of ramp portions, each ramp portion being positioned on a respective one of a pair of outer faces of said distal wedge member;

wherein each radial wedge portion has a respective base edge, wherein each said base edge is coplanar to each other said base edge of said radial wedge portions;

wherein each bottom edge of said planar sections is coplanar to said base of said central portion;

wherein each distal wedge member has a respective lower edge, wherein each lower edge is coplanar to each other lower edge of said distal wedge members;

wherein said lower edges of said distal wedge members are coplanar with said base edges of said radial wedge portions;

wherein said attachment portion includes a plate member, an extension portion coupled to said plate member, and a pair of spaced arm members extending from said plate member, said spaced arm members having aligned apertures such that said arm members are adapted for coupling to the boom arm;

each of said distal wedge members including a pair of spaced distal wedge apertures;

each of said planar sections having a pair of spaced threaded portions;

a plurality of threaded coupling members each being insertable through a respective one of said distal wedge apertures for removably coupling said distal wedge members to said planar sections;

wherein each of said planar sections includes a cutout portion adjacent to said bottom edge of said planar section, each said pair of threaded portions being positioned to extend into said respective planar section from said cutout portion such that a distal edge of said distal wedge member is aligned with a distal edge of said planar section when said distal wedge member is coupled to said planar section;

wherein said central wedge splitting member has a threaded connection portion and said central portion has a complimentary threaded opening such that said central wedge splitting member is removably couplable to said central portion;

a plurality of triangular planar section bracing members, each planar section bracing member being coupled to extend between said attachment portion and a top edge of a respective one of said planar sections; and a plurality of plate member bracing members, each plate member bracing member being coupled to extend between said plate member and said extension portion.

* * * * *